US005116032A

United States Patent [19]

Strachan

[11] Patent Number: 5,116,032

[45] Date of Patent: May 26, 1992

[54] ROLLINGTABLE WITH HEIGHT ADJUSTMENT AND BRAKE DEVICE

[75] Inventor: Julie Strachan, Brighton, England

[73] Assignee: Smiths Industries Public Limited Company, London, England

[21] Appl. No.: 677,568

[22] Filed: Mar. 29, 1991

[30] Foreign Application Priority Data

Apr. 4, 1990 [GB] United Kingdom ..... 9007606

[51] Int. Cl.[5] ..... A61G 13/00; B66F 3/24

[52] U.S. Cl. ..... 5/614; 254/93 R

[58] Field of Search ..... 269/322, 323, 17, 24; 254/93 R, 93 H, 93 L; 16/44

[56] References Cited

U.S. PATENT DOCUMENTS 2,709,827 6/1955 Volz ..... 16/44
3,028,732 4/1962 Shampaine et al. ..... 60/413
4,761,000 8/1988 Fisher et al. ..... 269/323
4,778,164 10/1988 Mueller et al. ..... 269/322

FOREIGN PATENT DOCUMENTS 1564040 4/1969 France .
1559945 1/1980 United Kingdom .

*Primary Examiner*—Bruce M. Kisliuk
*Assistant Examiner*—Eileen P. Morgan
*Attorney, Agent, or Firm*—Pollock, Vande Sande and Priddy

[57] ABSTRACT

An operating table or the like has a platform supported by a hydraulically adjustable column. Castors contact the floor through apertures in a base plate that supports a guide wheel. Application of hydraulic fluid to raise the platform causes the base plate to be lowered first to an intermediate position in which the guide wheel contacts the floor. Additional hydraulic pressure brings the base plate into contact with the floor so that the table is braked before the platform rises.

8 Claims, 2 Drawing Sheets

ROLLINGTABLE WITH HEIGHT ADJUSTMENT AND BRAKE DEVICE

BACKGROUND OF THE INVENTION

This invention relates to patient support tables such as surgical operating tables.

Surgical operating tables, such as described in British patent No. 1559945 are well known. Such tables generally comprise a patient supporting platform, a base and a support column which supports the platform on the base in such a way that the height of the platform can be altered with respect to the base. It is also known for the base to have several castors and/or a guidewheel enabling the table to be moved over the floor.

Such arrangements require that the table be provided with an electrical, hydraulic, pneumatic or mechanical system for altering the height. A separate system is used to apply a brake to prevent the table from moving over the floor when in use. Similar tables are used to transport patients between the hospital ward and the operating theater.

SUMMARY OF THE INVENTION

It is an object of the present invention to provide an improved form of surgical operating table or the like.

According to one aspect of the present invention there is provided a patient support table including a patient support platform, a base that is movable over the floor, an adjustable column that supports the platform on the base, and means for adjusting the column to vary the height of the platform relative to the floor, the adjusting means being arranged to brake movement of the base over the floor when force is applied to raise the platform.

The adjusting means may be hydraulic. The base preferably includes a plurality of castors. The castors may be mounted on a castor plate, the castor plate supporting a cylindrical housing that extends upwardly from the castor plate externally of the column. The base preferably includes a guidewheel that confines movement of the table to one direction when in contact with the floor. The base preferably includes a base plate member that is lowered to engage the floor and thereby brake movement of the base when force is applied to raise the platform. The guidewheel is preferably mounted on the base plate member, the guidewheel being arranged to contact the floor to confine movement of the table to the one direction when the base plate member is lowered to an intermediate position above that at which the base plate member contacts the floor. The guidewheel may be supported on the base plate member by a spring suspension that is deformed when the base plate member is lowered into contact with the floor.

A surgical operating table in accordance with the present invention, will now be described, by way of example, with reference to the accompanying drawings.

DESCRIPTION OF THE PREFERRED EMBODIMENTS

Figure 1:
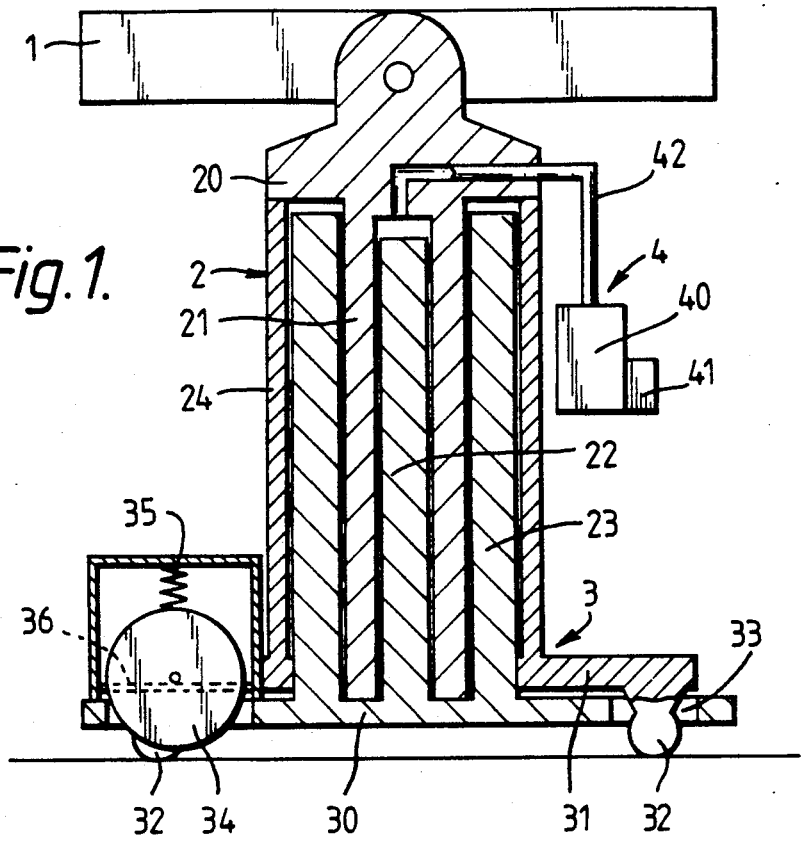
FIGS. 1 to 3 are schematic cross-section elevation views of the table in three different positions.

The surgical operating table comprises a patient support platform 1, a column 2, a base assembly 3 and a hydraulic system 4 by which the height of the platform is adjusted and the base is braked.

The platform 1 is of conventional construction and may be provided with the usual joints and mechanisms (not shown) by which the angle and shape of the platform is altered for different surgical purposes. The platform 1 is mounted at the upper end of the column 2.

The column 2 has an upper head portion 20 which is secured to the platform 1 and which defines a vertical hydraulic cylinder 21. Within the cylinder 21 is located a piston 22 which projects from the lower end of the cylinder and is joined with a horizontal base plate 30. The base plate 30 also supports a sleeve 23 which extends coaxially of the piston 22 and externally of the cylinder 21. The column 2 also includes a cylindrical housing 24 which extends coaxially up the outside of the sleeve 23 and which is supported at its lower end by a castor plate 31. In the position shown in FIG. 1, the upper end of the housing 24 abuts and supports the underside of the head portion 20.

The castor plate 31 and the base plate 30 together comprise the base assembly 3. The castor plate 31 has four castors 32, one at each corner of the plate, which project through apertures 33 in the base plate 30 and which are rotatable about their vertical axes. The weight of the table can be supported by the castors 32 to enable the table to be turned and moved over the floor in any direction. The base plate 30 supports a single guidewheel 34 of large diameter compared with the castors 32. The guidewheel 34 is fixed about a vertical axis relative to the base plate 30 so that, when in contact with the floor, it confines movement of the table to one direction. The guidewheel 34 is mounted on a spring suspension 35, shown only schematically in the drawings, so that it has limited resilient movement along a vertical axis. Downward movement of the guidewheel 34 is limited by engagement with a stop 36; upward movement is limited by compression of the suspension 35 or by engagement with a similar stop.

The height of the patient support platform 1 above the base assembly 3 is adjustable by the hydraulic system 4 which also serves to brake movement of the table over the floor. The hydraulic system 4 includes an hydraulic pump and oil reservoir 40 and a user control 41. An oil pipe 42 extends from the pump 40 to the upper end of the cylinder 21. When no oil pressure is applied, the volume of the cylinder 21 above the piston 22 is a minimum, as shown in FIG. 1. Increasing fluid pressure causes an increase in the volume of cylinder 21 above the piston 22, thereby pushing the piston outwardly of the cylinder and increasing the distance between the base plate 30 and the column head portion 20.

Operation of the table will now be described in greater detail with reference first to FIG. 1, which shows the table with the hydraulic system 4 unpressurized and with the platform 1 at its lowest height. In this state, the castors 32 and the housing 24 support the entire weight of the table, the base plate 30 being lifted clear of the floor to a height at which the guidewheel 34 engages its stop 36 and is lifted clear of the floor. The table can be freely moved over the floor and turned in any direction.

Once the table has been turned to the desired direction it can be confined to move in only this direction by bringing the guidewheel 34 down into contact with the floor. This is done by applying sufficient hydraulic pressure to the cylinder 21 to cause the piston 22 and the base plate 30 to be lowered to an intermediate position shown in FIG. 2. In this position, the guidewheel 34 contacts the floor and supports some of the weight of the table but the base plate 30 is still clear above the floor surface. The head portion 20 of the column 2 still abuts the upper end of the housing 24 and the overall height of the platform 1 above the floor surface is unchanged.

Figure 3:
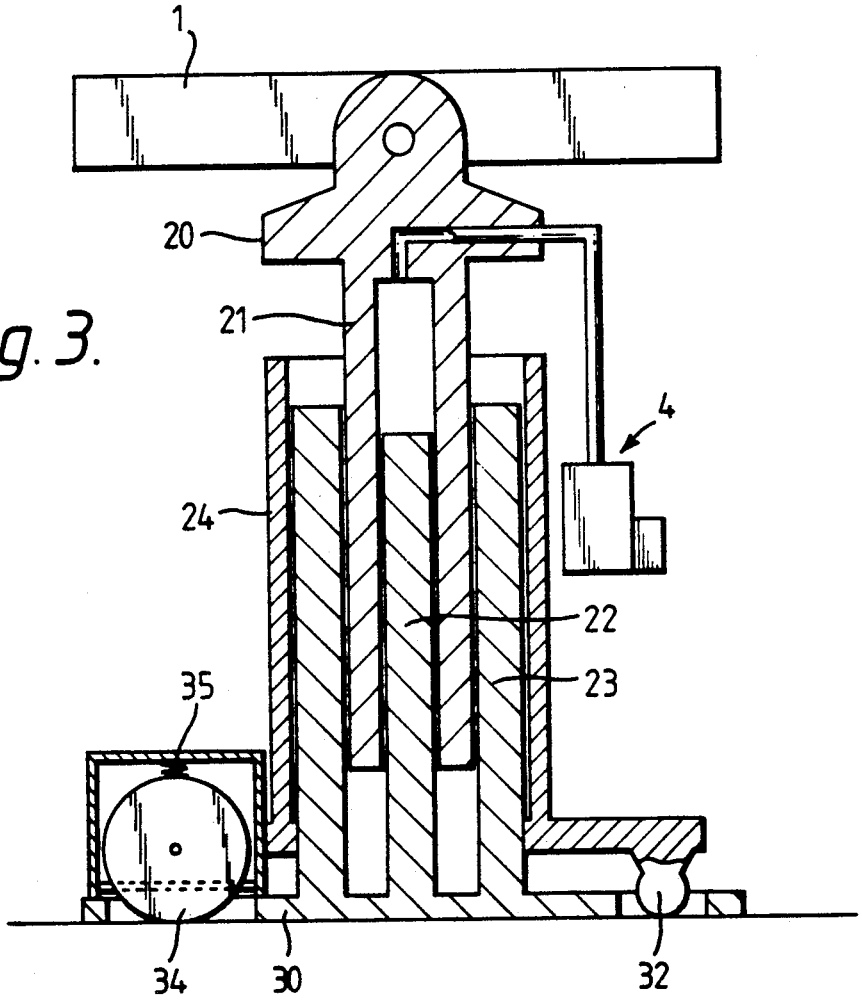

If further force is applied to raise the height of the platform 1, by increasing fluid pressure applied to the cylinder 21, this will force the base plate 30 into contact with the floor, as shown in FIG. 3. In this position, the suspension 35 of the guidewheel 34 is deformed by compression and the major part of the weight of the table is supported by the base plate 30 via the cylinder 21 and the piston 22. The castors 32 remain in contact with the floor but movement of the table over the floor is effectively braked by contact of the base plate 30 with the floor. Because the table is supported by a relatively large area plate, damage to the floor surface is minimized; the only weight supported by the castors 32 will be that of the castor plate 31 and the housing 24.

Movement of the table over the floor is braked before the height of the platform 1 changes. Once the base plate 30 contacts the floor, the platform can be raised to any desired height.

Figure 2:
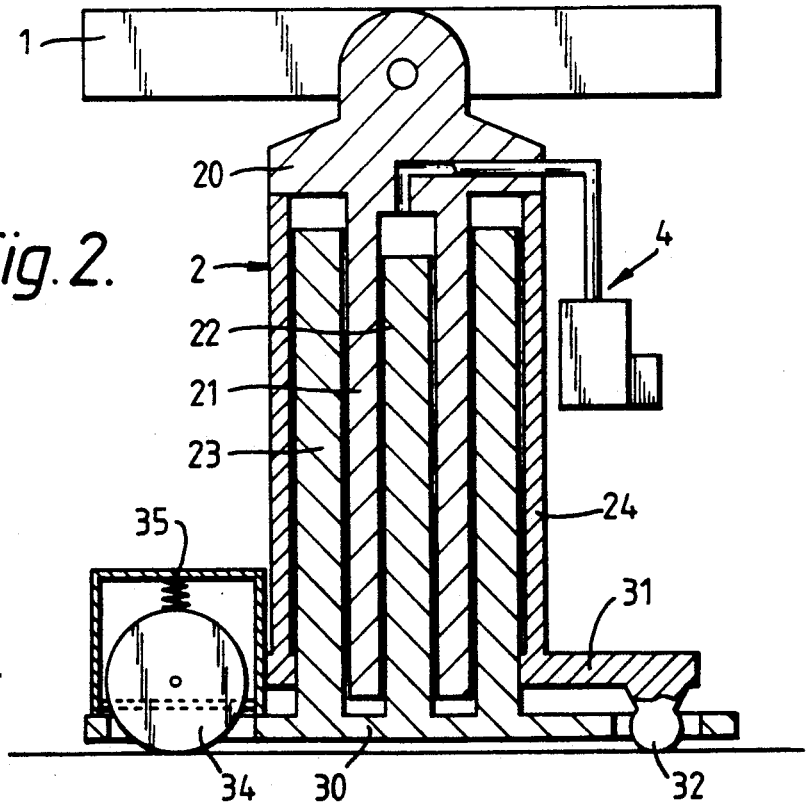

The height of the column 2 is selected so that, when the platform 1 is at the height shown in FIGS. 1 and 2, the platform will be below the lowest height needed for surgical procedures. It can be seen, therefore, that the act of raising the platform to a usable height will automatically brake any movement of the table over the floor, thereby giving the table a high intrinsic level of safety.

The construction and operation of the table is also simplified because only a single hydraulic system is needed to effect both the functions of raising the table height and braking its movement on the floor.

Instead of an hydraulic system, it would be possible to use any conventional alternative system such as a pneumatic, electrical or mechanical system to raise the height of the table. Instead of braking movement over the floor by bringing a plate into contact with the floor, it would be possible to brake the castors and, or alternatively, the guidewheel.

The invention is not confined to use with surgical operating tables but could be used with other patient support tables such as transfer trolleys.

What I claim is:

1. A patient support table comprising: a patient support platform; a base that is movable over a floor; an adjustable column that supports the platform on the base; and an hydraulic cylinder for adjusting the column to vary the height of the platform relative to the floor, said hydraulic cylinder being so mounted on said base that when hydraulic fluid is supplied to the cylinder to increase the height of the platform, the cylinder initially lowers the base to automatically brake movement of the base over the floor before the height of the platform is increased.

2. A patient support table according to claim 1, wherein the base includes a plurality of castors.

3. A patient support table according to claim 2, wherein the castors are mounted on a castor plate, and wherein the castor plate supports a cylindrical housing that extends upwardly from the castor plate externally of the column.

4. A patient support table according to claim 1, wherein the base includes a guidewheel, the guidewheel confining movement of the table to one direction when in contact with the floor.

5. A patient support table according to claim 1 wherein the base includes a base plate member, and wherein the base plate member engages the floor when hydraulic fluid is supplied to the cylinder to raise the platform.

6. A patient support table according to claim 5, wherein the table includes a guidewheel mounted on the base plate member, and wherein the guidewheel contacts the floor and confines movement of the table to one direction when the base plate member is lowered to an intermediate position above that at which the base plate member contacts the floor.

7. A patient support table according to claim 6, wherein the guidewheel is supported on the base plate member by a spring suspension, and wherein the spring suspension is deformed when the base plate member is lowered into contact with the floor.

8. A patient support table comprising: a patient support platform; a base that is movable over a floor surface; an adjustable column that supports the platform on the base; and means for adjusting the column to vary the height of the platform relative to the floor, the base including a plurality of castors, a base plate member, a guidewheel and a spring suspension mounting the guidewheel on the base plate member such that with the column in its lowest position both the base plate member and guidewheel are above the floor surface and the table is movable over the floor surface on the castors but when the adjusting means applies force to increase the height of the platform this causes the base plate member to be lowered before the height of the platform increases, the base plate member lowering initially to an intermediate position in which the guidewheel is in contact with the floor so as to confine movement of the table to one direction, and then to a position in which the base plate member engages the floor and thereby brakes movement of the table prior to raising the platform.

* * * * *